US009028624B2

(12) United States Patent
Sagawa et al.

(10) Patent No.: US 9,028,624 B2
(45) Date of Patent: May 12, 2015

(54) NDFEB SYSTEM SINTERED MAGNET AND METHOD FOR PRODUCING THE SAME

(71) Applicant: Intermetallics Co., Ltd., Kyoto-shi, Kyoto (JP)

(72) Inventors: Masato Sagawa, Kyoto (JP); Tetsuhiko Mizoguchi, Kyoto (JP)

(73) Assignee: Intermetallics Co., Ltd., Nakatsugawa (JP)

( * ) Notice: Subject to any disclaimer, the term of this patent is extended or adjusted under 35 U.S.C. 154(b) by 0 days.

(21) Appl. No.: 14/113,961

(22) PCT Filed: Dec. 27, 2012

(86) PCT No.: PCT/JP2012/083786

§ 371 (c)(1),
(2) Date: Oct. 25, 2013

(87) PCT Pub. No.: WO2013/100008

PCT Pub. Date: Jul. 4, 2013

(65) Prior Publication Data

US 2014/0327503 A1 Nov. 6, 2014

(30) Foreign Application Priority Data

Dec. 27, 2011 (JP) ..... 2011-286864

(51) Int. Cl.
*H01F 7/02* (2006.01)
*H01F 1/057* (2006.01)
(Continued)

(52) U.S. Cl.
CPC *H01F 7/02* (2013.01); *C22C 33/02* (2013.01); *H01F 1/057* (2013.01); *B22F 1/0011* (2013.01);
(Continued)

(58) Field of Classification Search
CPC ..... H01F 7/02; H01F 1/057; H01F 41/02; H01F 41/0266
USPC ..... 148/100–108; 419/23
See application file for complete search history.

(56) References Cited

U.S. PATENT DOCUMENTS

2007/0151632 A1 7/2007 Komuro et al.
2008/0241368 A1 10/2008 Komuro et al.
(Continued)

FOREIGN PATENT DOCUMENTS

CN 1698142 A 11/2005
CN 1898757 A 1/2007
(Continued)

OTHER PUBLICATIONS

Sepehri-Amin et al., "Grain boundary structure and chemistry of Dy-diffusion processed Nd—Fe—B sintered magnets," Journal of Applied Physics, vol. 107, 2010, pp. 09A745-1-09A745-3.
(Continued)

*Primary Examiner* — Jessee Roe
(74) *Attorney, Agent, or Firm* — Oliff PLC

(57) ABSTRACT

Provided is a NdFeB sintered magnet which can be used in the grain boundary diffusion method as a base material in which $R_H$ can be easily diffused through the rare-earth rich phase and which itself has a high coercive force, a high maximum energy product and a high squareness ratio, as well as a method for producing such a magnet. A NdFeB system sintered has an average grain size of the main-phase grains magnet is equal to or smaller than 4.5 μm, the carbon content of the entire NdFeB system sintered magnet is equal to or lower than 1000 ppm, and the percentage of the total volume of a carbon rich phase in a rare-earth rich phase at a grain-boundary triple point in the NdFeB system sintered magnet to the total volume of the rare-earth rich phase is equal to or lower than 50%.

2 Claims, 5 Drawing Sheets

(51) Int. Cl.

| | |
|---|---|
| ***H01F 41/02*** | (2006.01) |
| ***B22F 1/00*** | (2006.01) |
| ***H01F 1/055*** | (2006.01) |
| *C22C 33/02* | (2006.01) |
| *B22F 9/02* | (2006.01) |

(52) U.S. Cl.
CPC ..... *B22F 9/023* (2013.01); *H01F 1/0557* (2013.01); *H01F 41/0266* (2013.01); *H01F 1/0577* (2013.01); *H01F 41/0293* (2013.01)

(56) References Cited

U.S. PATENT DOCUMENTS

| | | | |
|---|---|---|---|
| 2008/0241513 | A1 | 10/2008 | Komuro et al. |
| 2008/0286595 | A1 | 11/2008 | Yoshimura et al. |
| 2010/0182113 | A1 | 7/2010 | Yoshimura et al. |
| 2010/0231338 | A1 | 9/2010 | Morimoto et al. |
| 2010/0282371 | A1 | 11/2010 | Sagawa et al. |
| 2011/0260816 | A1 | 10/2011 | Morimoto et al. |
| 2012/0025651 | A1 | 2/2012 | Komuro et al. |
| 2012/0111232 | A1 | 5/2012 | Komuro et al. |
| 2012/0176211 | A1 | 7/2012 | Sagawa |
| 2012/0206227 | A1 | 8/2012 | Yoshimura et al. |
| 2013/0135069 | A1 | 5/2013 | Miyamoto et al. |

FOREIGN PATENT DOCUMENTS

| | | | |
|---|---|---|---|
| CN | 101276665 | A | 10/2008 |
| CN | 101276666 | A | 10/2008 |
| CN | 101375352 | A | 2/2009 |
| CN | 101652821 | A | 2/2010 |
| CN | 102308342 | A | 1/2012 |
| CN | 102483979 | A | 5/2012 |
| EP | 1 793 392 | A2 | 6/2007 |
| EP | 1 923 893 | A1 | 5/2008 |
| EP | 1 981 043 | A1 | 10/2008 |
| EP | 2 169 689 | A1 | 3/2010 |
| EP | 2 453 448 | A1 | 5/2012 |
| JP | 2003-297622 | A | 10/2003 |
| JP | 2004-256877 | A | 9/2004 |
| JP | A-2008-266767 | | 11/2008 |
| JP | A-2008-270699 | | 11/2008 |
| JP | 2008-305908 | A | 12/2008 |
| JP | A-2011-223007 | | 11/2011 |
| JP | B2-4831074 | | 12/2011 |
| JP | A-2012-136778 | | 7/2012 |
| KR | 10-2010-0027111 | | 3/2010 |
| WO | WO 2006/043348 | A1 | 4/2006 |
| WO | WO 2007/088718 | A1 | 8/2007 |
| WO | WO 2009/004794 | A1 | 1/2009 |
| WO | WO 2010/109760 | A1 | 9/2010 |
| WO | WO 2011/004894 | A1 | 1/2011 |
| WO | WO 2011/125591 | A1 | 10/2011 |

OTHER PUBLICATIONS

Li et al., "Distribution of Dy in high-coercivity (Nd,Dy)—Fe—B sintered magnet," Acta Materialia, vol. 59, 2011, pp. 3061-3069.

Extended European Search Report dated Jun. 30, 2014 issued in European Patent Application No. 12861799.0.

Extended European Search Report dated Jun. 30, 2014 issued in European Patent Application No. 12863295.7.

Extended European Search Report dated Jul. 1, 2014 issued in European Patent Application No. 12863911.9.

Korean Office Action dated Sep. 17, 2014 issued in Korean Patent Application No. 10-2013-7023817 (with translation).

Korean Office Action dated Sep. 17, 2014 issued in Korean Patent Application No. 10-2013-7023816 (with translation).

Sep. 24, 2013 Office Action issued in Japanese Patent Application No. 2013-536353 (with English translation).

Apr. 16, 2013 International Search Report issued in International Patent Application No. PCT/JP2012/083788.

Apr. 16, 2013 Written Opinion of the International Searching Authority issued in International Patent Application No. PCT/JP2012/083788.

Apr. 16, 2013 International Search Report issued in International Patent Application No. PCT/JP2012/083786.

Apr. 16, 2013 Written Opinion of the International Searching Authority issued in International Patent Application No. PCT/JP2012/083786.

Apr. 16, 2013 International Search Report issued in International Patent Application No. PCT/JP2012/083787.

Apr. 16, 2013 Written Opinion of the International Searching Authority issued in International Patent Application No. PCT/JP2012/083787.

Apr. 16, 2013 International Search Report issued in International Patent Application No. PCT/JP2012/083789.

Apr. 16, 2013 Written Opinion of the International Searching Authority issued in International Patent Application No. PCT/JP2012/083789.

Sep. 24, 2013 Office Action issued in Japanese Patent Application No. 2013-536354 (with English translation).

U.S. Appl. No. 14/114,657 in the name of Sagawa et al. filed Oct. 29, 2013.

U.S. Appl. No. 14/114,653 in the name of Sagawa et al. filed Oct. 29, 2013.

U.S. Appl. No. 14/114,656 in the name of Sagawa et al. filed Oct. 29, 2013.

Feb. 12, 2014 Office Action issued in Japanese Patent Application No. 2013-536354 (with translation).

May 8, 2014 Office Action issued in Chinese Patent Application No. 201280021367.0 (with translation).

Chinese Office Action dated Jul. 8, 2014 issued in Chinese Patent Application No. 201280021386.3 (with partial translation).

Jan. 5, 2015 Office Action issued in U.S. Appl. No. 14/114,656.

Jan. 5, 2015 Office Action issued in U.S. Appl. No. 14/114,653.

J.M.D. Coey, "Rare-earth Iron Permanent Magnets," Clarendon press, Oxford, pp. 348-353, (1996): 2.2.2 Hydrogen decrepitation (HD).

F. Vial et al., "Improvement of coercivity of sintered NdFeB permanent magnets by heat treatment," Journal of Magnetism and Magnetic Materials 242-245, pp. 1329-1334, (2002).

Jan. 5, 2015 Office Action issued in Chinese Patent Application No. 201280021367.0.

C/Nd=5.6% C/Nd=19.6% C/Nd=50.0%

C/Nd=95.6% C/Nd=100% C/Nd=98.6%

NDFEB SYSTEM SINTERED MAGNET AND METHOD FOR PRODUCING THE SAME

TECHNICAL FIELD

The present invention relates to a NdFeB (neodymium-iron-boron) system sintered magnet suitable as a base material for a grain boundary diffusion method, and to a method for producing such a NdFeB system sintered magnet.

BACKGROUND ART

NdFeB system sintered magnets were discovered by Sagawa (one of the present inventors) and other researchers in 1982. NdFeB system sintered magnets exhibit characteristics far better than those of conventional permanent magnets, and can be advantageously manufactured from raw materials such as Nd (a kind of rare-earth element), iron, and boron, which are relatively abundant and inexpensive. Hence, NdFeB system sintered magnets are used in a variety of products, such as driving motors for hybrid or electric cars, battery-assisted bicycle motors, industrial motors, voice coil motors used in hard disks and other apparatuses, high-grade speakers, headphones, and permanent magnetic resonance imaging systems. NdFeB system sintered magnets used for those purposes must have a high coercive force $H_{cJ}$, a high maximum energy product $(BH)_{max}$, and a high squareness ratio SQ. The squareness ratio SQ is defined as $H_k/H_{cJ}$, where $H_k$ is the absolute value of the magnetic field when the magnetization value corresponding to a zero magnetic field is decreased by 10% on the magnetization curve extending across the boundary of the first and second quadrants of a graph with the horizontal axis indicating the magnetic field and the vertical axis indicating the magnetization.

One method for enhancing the coercive force of a NdFeB system sintered magnet is a "single alloy method", in which Dy and/or Tb (the "Dy and/or Tb" is hereinafter represented by "$R_H$") is added to a starting alloy when preparing the alloy. Another method is a "binary alloy blending technique", in which a main phase alloy which does not contain $R_H$ and a grain boundary phase alloy to which $R_H$ is added are prepared as two kinds of starting alloy powder, which are subsequently mixed together and sintered. Still another method is a "grain boundary diffusion method", which includes the steps of creating a NdFeB system sintered magnet as a base material, attaching $R_H$ to the surface of the base material by an appropriate process, (such as application or vapor deposition), and heating the magnet to diffuse $R_H$ from the surface of the base material into the inner region through the boundaries inside the base material (Patent Document 1).

The coercive force of a NdFeB sintered magnet can be enhanced by any of the aforementioned methods. However, it is known that the maximum energy product decreases if $R_H$ is present in the main-phase grains inside the sintered magnet. In the case of the single alloy method, since $R_H$ is mixed in the main-phase grains at the stage of the starting alloy powder, a sintered magnet created from that powder inevitably contains $R_H$ in its main-phase grains. Therefore, the sintered magnet created by the single alloy method has a relatively low maximum energy product while it has a high coercive force.

In the case of the binary alloy blending technique, the largest portion of $R_H$ will be held in the boundaries of the main-phase grains. Therefore, as compared to the single alloy method, the technique can reduce the amount of decrease in the maximum energy product. Another advantage over the single alloy method is that the amount of use of the rare metal, i.e. $R_H$, is reduced.

In the grain boundary diffusion method, $R_H$ attached to the surface of the base material is diffused into the inner region through the boundaries liquefied by heat in the base material. Therefore, the diffusion rate of $R_H$ in the boundaries is much higher than the rate at which $R_H$ is diffused from the boundaries into the main-phase grains, so that $R_H$ is promptly supplied into deeper regions of the base material. By contrast, the diffusion rate from the boundaries into the main-phase grains is low, since the main-phase grains remain in the solid state. This difference in the diffusion rate can be used to regulate the temperature and time of the heating process so as to realize an ideal state in which the $R_H$ concentration is high only in the vicinity of the surface of the main-phase grains (grain boundaries) in the base material while the same concentration is low inside the main-phase grains. Thus, it is possible to make the amount of decrease in the maximum energy product $(BH)_{max}$ smaller than in the case of the binary alloy blending technique while enhancing the coercive force. Another advantage over the binary alloy blending technique is that the amount of use of the rare metal, i.e. $R_H$, is reduced.

There are two kinds of methods for producing NdFeB system sintered magnets: a "press-applied magnet-production method" and a "press-less magnet-production method." In the press-applied magnet-production method, fine powder of a starting alloy (which is hereinafter called the "alloy powder") is put in a mold, and a magnetic field is applied to the alloy powder while pressure is applied to the alloy powder with a pressing machine, whereby the creation of a compression-molded body and the orientation of the same body are simultaneously performed. Then, the compression-molded body is removed from the mold and sintered by heat. In the press-less magnet-production method, alloy powder which has been put in a predetermined filling container is oriented and sintered as it is held in the filling container, without undergoing the compression molding.

The press-applied magnet-production method requires a large-size pressing machine to create a compression-molded body. Therefore, it is difficult to perform the process in a closed space. By contrast, in the press-less magnet-production process, which does not use a pressing machine, the processes from the filling through the sintering can be performed in a closed space.

BACKGROUND ART DOCUMENT

Patent Document

Patent Document 1: WO2006/043348
Patent Document 2: WO2011/004894

SUMMARY OF THE INVENTION

Problem to be Solved by the Invention

In the grain boundary diffusion method, the condition of the grain boundary significantly affects the way the $R_H$ attached to the surface of the base material by deposition, application or another process is diffused into the base material, such as how easily $R_H$ will be diffused and how deep it can be diffused from the surface of the base material. One of the present inventors has discovered that a rare-earth rich phase (i.e. the phase containing rare-earth elements in higher proportions than the main-phase grains) in the grain boundary serves as the primary passage for the diffusion of $R_H$ in the grain boundary diffusion method, and that the rare-earth rich phase should preferably continue, without interruption, through the grain boundaries of the base material in order to diffuse $R_H$ to an adequate depth from the surface of the base material (Patent Document 2).

A later experiment conducted by the present inventors has revealed the following fact: In the production of a NdFeB system sintered magnet, an organic lubricant is added to the alloy powder in order to reduce the friction between the grains of the alloy powder and help the grains easily rotate in the orienting process, as well as for other purposes. The lubricant contains carbon. Although the carbon contents are mostly oxidized during the sintering process and released to the outside of the NdFeB system sintered magnet, a portion of the carbon atoms remains inside the magnet. Among the remaining carbon atoms, those which remain at a grain-boundary triple point (a portion of the grain boundary surrounded by three or more main-phase grains) are cohered together, forming a carbon rich phase (a phase whose carbon concentration is higher than the average of the entire NdFeB system sintered magnet) in the rare-earth rich phase. As already noted, the rare-earth rich phase existing in the grain boundary serves as the primary passage for the diffusion of $R_H$ into the inner region of the NdFeB system sintered magnet. Conversely, the carbon rich phase formed in the rare-earth rich phase acts like a weir which blocks the diffusion passage of $R_H$ and impedes the diffusion of $R_H$ through the grain boundary.

The problem to be solved by the present invention is to provide a NdFeB system sintered magnet which can be used in the grain boundary diffusion method as a base material in which $R_H$ can be easily diffused through the rare-earth rich phase and which can achieve a higher coercive force, as well as a method for producing such a NdFeB system sintered magnet.

Means for Solving the Problem

A NdFeB system sintered magnet according to the present invention aimed at solving the aforementioned problem is characterized in that:

a) the average grain size of the main-phase grains in the NdFeB system sintered magnet is equal to or smaller than 4.5 μm;

b) the carbon content of the entire NdFeB system sintered magnet is equal to or lower than 1000 ppm; and c) the percentage of the total volume of a carbon rich phase in a rare-earth rich phase at a grain-boundary triple point in the NdFeB system sintered magnet to the total volume of the rare-earth rich phase is equal to or lower than 50%.

As a result of various experiments, the present inventors have discovered that, if a NdFeB system sintered magnet which satisfies the previously described conditions is used as the base material for the grain boundary diffusion method, $R_H$ can be easily diffused through the rare-earth rich phase into the inner region of the base material.

The NdFeB system sintered magnet according to the present invention is produced in a controlled manner so as to make the average grain size of the main-phase grains equal to or smaller than 4.5 μm and thereby increase the coercive force of the base material itself. Furthermore, the carbon content of the NdFeB system sintered magnet is suppressed to 1000 ppm or lower, and the volume ratio of the carbon rich phase (i.e. the "percentage of the total volume of a carbon rich phase in a rare-earth rich phase at a grain-boundary triple point in the NdFeB system sintered magnet to the total volume of the rare-earth rich phase") is suppressed to 50% or lower, whereby the passage formed by the rare-earth rich phase is prevented from being completely blocked by the carbon rich phase. As a result, $R_H$ can be diffused through the rare-earth rich phase into the inner region of the base material without being blocked halfway.

It has been experimentally demonstrated that the NdFeB system sintered magnet according to the present invention can not only achieve a high coercive force but also has a higher maximum energy product and a higher squareness ratio than conventional NdFeB system sintered magnets, even before the grain boundary diffusion method is applied. The results of the experiments will be described later.

The present invention also provides a method for producing the previously described NdFeB system sintered magnet, which includes:

a) a hydrogen pulverization process for coarsely pulverizing a NdFeB system alloy by making the NdFeB system alloy occlude hydrogen;

b) a fine pulverization process for finely pulverizing the coarsely pulverized NdFeB system alloy so that the grain size of the alloy will be equal to or smaller than 3.2 μm in terms of the median $D_{50}$ of the grain size distribution measured by a laser diffraction method; and c) a press-less magnet-production process including the step of putting fine powder of the NdFeB alloy into a filling container and the subsequent step of orienting and sintering the fine powder as held in the filling container, wherein:

the fine pulverization process and the press-less magnet-production process are performed without thermal dehydrogenation for desorbing the hydrogen occluded in the hydrogen pulverization process; and the processes from the hydrogen pulverization process through the press-less magnet-production process are performed in an oxygen-free atmosphere.

As explained earlier, there are two kinds of methods for producing NdFeB system sintered magnets, the press-applied magnet-production method and the press-less magnet-production method. In the press-applied magnet-production method, the thermal dehydrogenation for desorbing hydrogen is performed for two reasons. The first reason is that the alloy powder containing a hydrogen compound easily undergoes oxidization and deteriorates the magnetic characteristics of the magnet after the production. The second reason is that, after the compression-molded body is created by a pressing machine, the hydrogen is desorbed naturally or due to the heat during the sintering process, turning into molecules and expanding in the form of gas inside the compression-molded body before this body is completely sintered, which may lead to breakage of the compression-molded body.

The thermal dehydrogenation is also performed in the press-less magnet-producing method for the first aforementioned reason.

The present inventors have reexamined each of the processes in order to produce a NdFeB system sintered magnet having even higher magnetic characteristics. As a result, it has been found that, if the alloy powder contains a hydrogen compound, the carbon which is introduced through the lubricant added to the alloy powder before the orienting process (e.g. in the process of putting the alloy powder into a filling container) reacts with the hydrogen compound during the sintering process, to be eventually removed in the form of $CH_4$ gas. Therefore, the carbon content and the volume of the carbon rich phase in the rare-earth rich phase of the sintered body are decreased before the grain boundary diffusion treatment, so that $R_H$ can be diffused to adequately deep regions inside the sintered body through the rare-earth rich phase in the grain boundaries without being impeded by the carbon rich phase during the grain boundary diffusion treatment. In the NdFeB system sintered magnet produced by the method according to the present invention, both the carbon content and the volume ratio of the carbon rich phase can be suppressed to extremely low levels, the former being 1000 ppm or lower and the latter being 50% or lower.

In the press-less magnet-production method, a series of the processes from the pulverization of the starting alloy through the sintering can be performed in a closed space. Accordingly, in the present invention, this series of the processes are performed in an oxygen-free atmosphere so as to prevent oxidization of the alloy powder containing a hydrogen compound. Another merit of the press-less magnet-production method is that the aforementioned breakage of the compression-molded body will not occur since the alloy powder is sintered as it is held in the filling container.

It is generally known that the smaller the grain size of the alloy powder is, the higher the coercive force of the NdFeB system sintered magnet can be. However, an alloy powder having a smaller grain size is easier to be oxidized. Using such an alloy powder may deteriorate the magnetic characteristics or cause some kind of accident (e.g. ignition).

As already explained, in the method for producing a NdFeB system sintered magnet according to the present invention, the processes from the pulverization of a NdFeB system alloy through the sintering are entirely performed in an oxygen-free atmosphere. Therefore, the aforementioned deterioration in the magnetic characteristics or the accident due to the oxidization will not occur even if the alloy is pulverized into an extremely fine powder with an average grain size of 3.2 μm or smaller. Thus, a NdFeB system sintered magnet having a high coercive force can be produced.

When the average grain size of the alloy powder is equal to or smaller than 3.2 μm, the average grain size of the main-phase grains in the magnet after the sintering will be equal to or smaller than 4.5 μm.

Since the method for producing a NdFeB system sintered magnet according to the present invention does not use thermal dehydrogenation, it is possible to omit the period of time for thermal dehydrogenation, which normally requires anywhere from a few to several hours. Thus, the present invention simplifies the production process, shortens the production time, and reduces the production cost.

An experiment has also revealed that, in the method for producing a NdFeB system sintered magnet according to the present invention, the rate of pulverization of the starting alloy in the fine pulverization process can be higher than in conventional cases, and that an optimal sintering temperature used in the sintering treatment in the press-less process can be lower than the conventional levels by 5-20 degrees Celsius. The higher pulverization rate leads to a shorter production time. The lower optimal sintering temperature leads to the saving of energy as well as an extension of the service life of the filling container.

The present inventors have conducted a detailed study on what kind of effect will be made on the grains of the alloy powder by omitting the thermal dehydrogenation. The result demonstrated that the degree of anisotropy of the alloy-powder grains is lower than in the case where the thermal dehydrogenation is performed. However, it has the effect of suppressing the disorder of the alloy-powder grains due to the mutual repulsion of the grains in the orienting process and thereby improving the degree of orientation of the NdFeB system sintered magnet obtained by the sintering. The study has also showed that the hydrogen combined with the grains of the alloy powder will react with carbon due to the heat during the sintering process and will be eventually desorbed, so that the decrease in the anisotropy resulting from the reaction of the alloy-powder grains with hydrogen will not affect the magnetic characteristics of the magnet obtained by the sintering.

Effect of the Invention

The NdFeB system sintered magnet according to the present invention has the characteristic of allowing $R_H$ to be easily diffused into deeper regions by the grain boundary diffusion method, and therefore, can also be suitably used as the base material for the grain boundary diffusion method. With the method for producing a NdFeB system sintered magnet according to the present invention, it is possible to not only produce a NdFeB system sintered magnet suitable as the base material for the grain boundary diffusion method, but also obtain various effects, such as the simplification of the production process, the reduction in the production time, and the reduction in the production cost. The disorder of the powder grains due to their mutual repulsion in the orienting process can also be alleviated.

BEST MODE FOR CARRYING OUT THE INVENTION

One example of the NdFeB system sintered magnet according to the present invention and its production method is hereinafter described.

EXAMPLE

A method for producing a NdFeB system sintered magnet according to the present example and a method according to a comparative example are hereinafter described by means of the flowcharts of FIGS. 1 and 2.

Figure 1:
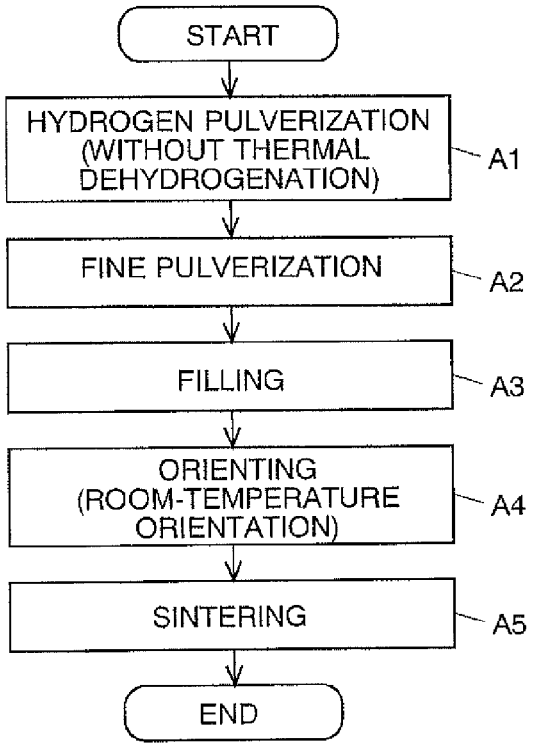
FIG. 1 is a flowchart showing one example of the method for producing a NdFeB system sintered magnet according to the present invention.

As shown in FIG. 1, the method for producing a NdFeB system sintered magnet according to the present example includes: a hydrogen pulverization process (Step A1), in which a NdFeB system alloy prepared beforehand by a strip cast method is coarsely pulverized by making the alloy occlude hydrogen; a fine pulverization process (Step A2), in which 0.05-0.1 wt % of methyl caprylate or similar lubricant is mixed in the NdFeB system alloy that has not undergone thermal dehydrogenation after being hydrogen-pulverized in the hydrogen pulverization process, and the alloy is finely pulverized in a nitrogen gas stream by a jet mill so that the grain size of the alloy will be equal to or smaller than 3.2 μm in terms of the median ($D_{50}$) of the grain size distribution measured by a laser diffraction method; a filling process (Step A3), in which 0.05-0.15 wt % of methyl laurate or similar lubricant is mixed in the finely pulverized alloy powder and the mixture is put in a mold (filling container) at a density of 3.0-3.5 g/cm$^3$; an orienting process (Step A4), in which the alloy powder held in the mold is oriented in a magnetic field at room temperature; and a sintering process (Step A5), in which the oriented alloy powder in the mold is sintered.

The processes of Steps A3 through A5 are performed as a press-less process. The entire processes from Steps A1 through A5 are performed in an oxygen-free atmosphere.

Figure 2:
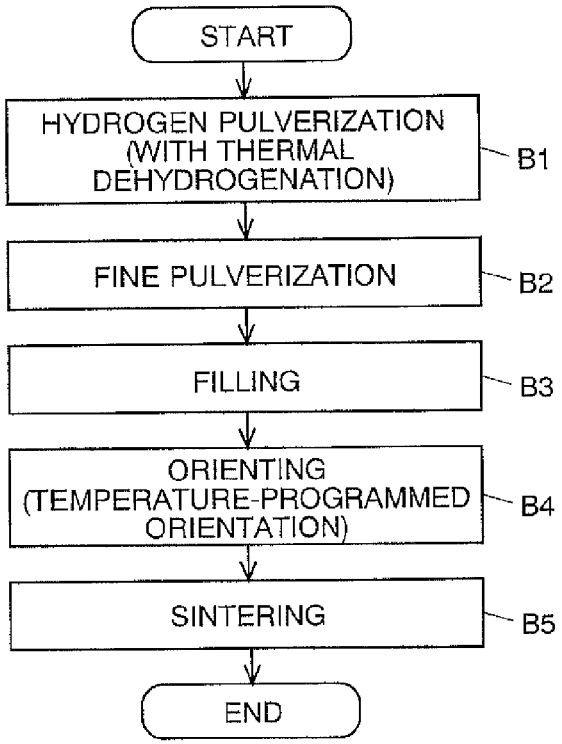
FIG. 2 is a flowchart showing a method for producing a NdFeB system sintered magnet according to a comparative example.

As shown in FIG. 2, the method for producing a NdFeB system sintered magnet according to the comparative example is the same as shown by the flowchart of FIG. 1 except for the hydrogen pulverization process (Step B1), in which thermal dehydrogenation for desorbing the hydrogen is performed after the NdFeB system alloy has been made to occlude hydrogen, as well as the orienting process (Step B4), in which a temperature-programmed orientation for heating the alloy powder is performed before, after or in the middle of the magnetic-field orientation.

The temperature-programmed orientation is a technique in which the alloy powder is heated in the orienting process so as to lower the coercive force of each individual grain of the alloy powder and thereby suppress the mutual repulsion of the grains after the orientation. By this technique, it is possible to improve the degree of orientation of the NdFeB system sintered magnet after the production.

Figure 3:
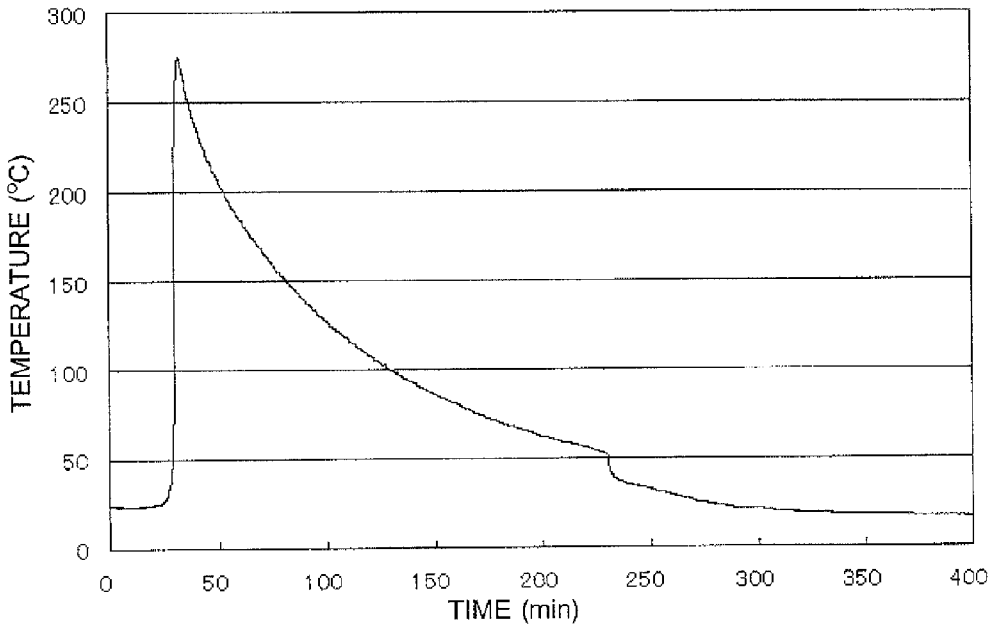
FIG. 3 is a graph showing a temperature history of a hydrogen pulverization process in the method for producing a NdFeB system sintered magnet according to the present example.

A difference between the method of producing a NdFeB system sintered magnet according to the present example and the method according to the comparative example is hereinafter described with reference to the temperature history of the hydrogen pulverization process. FIG. 3 is the temperature history of the hydrogen pulverization process (Step A1) in the method for producing a NdFeB system sintered magnet according to the present invention, and FIG. 4 is the temperature history of the hydrogen pulverization process (Step B1) in the method for producing a NdFeB system sintered magnet according to the comparative example.

Figure 4:
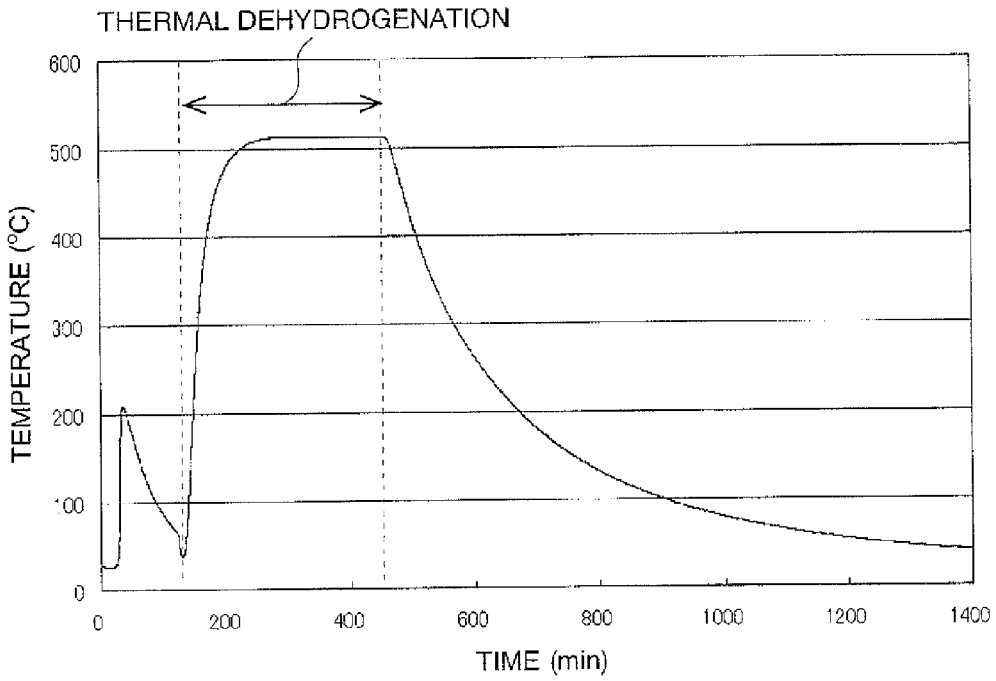
FIG. 4 is a graph showing a temperature history of a hydrogen pulverization process in the method for producing a NdFeB system sintered magnet according to the comparative example.

FIG. 4 is a temperature history of a general hydrogen pulverization process in which thermal dehydrogenation is performed. In the hydrogen pulverization process, a slice of the NdFeB system alloy is made to occlude hydrogen. This hydrogen occlusion process is an exoergic reaction and causes the temperature of the NdFeB system alloy to rise to approximately 200-300 degrees Celsius. Subsequently, the alloy is naturally cooled to room temperature while being vacuum-deaerated. In the meantime, the hydrogen occluded in the alloy expands, causing a large number of cracks inside the alloy, whereby the alloy is pulverized. In this process, a portion of the hydrogen reacts with the alloy. In order to desorb this hydrogen which has reacted with the alloy, the alloy is heated to approximately 500 degrees Celsius and then naturally cooled to room temperature. In the example of FIG. 4, the entire hydrogen pulverization process requires approximately 1400 minutes, including the period of time for the desorption of the hydrogen.

By contrast, the method for producing a NdFeB system sintered magnet according to the present example does not use the thermal dehydrogenation. Therefore, as shown in FIG. 3, even if a somewhat longer period of time is assigned for cooling the alloy to room temperature while performing the vacuum deaeration after the temperature rise due to the exoergic reaction, the hydrogen pulverization process can be completed in approximately 400 minutes. The production time is about 1000 minutes (16.7 hours) shorter than in the case of FIG. 4.

Thus, with the method for producing a NdFeB system sintered magnet according to the present example, it is possible to simplify the production process as well as significantly reduce the production time.

For each of the alloys having the compositions shown in Table 1 as Composition Numbers 1-4, the method for producing a NdFeB system sintered magnet according to the present example and the method for producing a NdFeB system sintered magnet according to the comparative example were applied. The results were as shown in Table 2.

Each of the results shown in Table 2 were obtained under the condition that the grain size of the alloy powder after the fine pulverization was controlled to be 2.82 μm in terms of $D_{50}$ measured by a laser diffraction method. A 100 AFG-type jet mill manufactured by Hosokawa Micron Corporation was used as the jet mill for the fine pulverization process. A magnetic characteristics measurement device manufactured by Nihon Denji Sokki co., ltd (product name: Pulse BH Curve Tracer PBH-1000) was used for the measurement of the magnetic characteristics.

In Table 2, the data of "Dehydrogenation: No" and "Temperature-Programmed Orientation: No" show the results of the method for producing a NdFeB system sintered magnet according to the present example, while the data of "Dehydrogenation: Yes" and "Temperature-Programmed Orientation: Yes" show the results of the method for producing a NdFeB system sintered magnet according to the comparative example.

TABLE 1

| Composition No. | Nd | Pr | Dy | Co | B | Al | Cu | Fe |
|---|---|---|---|---|---|---|---|---|
| 1 | 25.8 | 4.88 | 0.29 | 0.99 | 0.94 | 0.22 | 0.11 | bal. |
| 2 | 24.7 | 5.18 | 1.15 | 0.98 | 0.94 | 0.22 | 0.11 | bal. |
| 3 | 23.6 | 5.08 | 2.43 | 0.98 | 0.95 | 0.19 | 0.12 | bal. |
| 4 | 22.0 | 5.17 | 3.88 | 0.99 | 0.95 | 0.21 | 0.11 | bal. |

TABLE 2

| Composition No. | Dehydrogenation | Pulverization Rate (g/min) | Temperature-Programmed Orientation | Sintering Temperature (° C.) | HcJ (kOe) | Br/Js (%) |
|---|---|---|---|---|---|---|
| 1 | Yes | | Yes | 1005 | 15.50 | 96.1 |
| 1 | No | 30.7 | No | 985 | 15.68 | 96.0 |
| 2 | Yes | 19.9 | Yes | 1005 | 16.25 | 95.2 |
| 2 | No | 31.7 | No | 985 | 17.71 | 95.5 |
| 3 | Yes | 19.7 | Yes | 1005 | 17.79 | 95.2 |
| 3 | No | 30.0 | No | 985 | 20.12 | 95.8 |
| 4 | Yes | 17.7 | Yes | 1015 | 20.49 | 95.6 |
| 4 | No | 25.7 | No | 1010 | 21.86 | 96.6 |

As shown in Table 2, when the thermal dehydrogenation was not performed, the pulverization rate of the alloy in the fine pulverization process was higher than in the case where the thermal dehydrogenation was performed, regardless of which composition of the alloy was used. This is probably because, in the case where the thermal dehydrogenation is performed, the structure inside the alloy which has been embrittled due to the hydrogen occlusion recovers its toughness as a result of the thermal dehydrogenation, whereas, in the case where the thermal dehydrogenation is not performed, the structure remains embrittled. Thus, the production method according to the present example in which the thermal dehydrogenation is not performed has the effect of reducing the production time as compared to the conventional method in which the thermal dehydrogenation is performed.

Although no temperature-programmed orientation was performed, the production method according to the present example achieved high degrees of orientation $B_r/J_s$ which exceeded 95% and were comparable to the levels achieved by the production method according to the comparative example in which the temperature-programmed orientation was performed. A detailed study by the present inventors has revealed the fact that the magnetic anisotropy of the grains of the alloy powder (i.e. the coercive force of each individual grain) becomes lower in the case where the thermal dehydrogenation is not performed. When the coercive force of the individual grains is low, each grain will be a multi-domain structure in which reverse magnetic domains are formed along with the weakening of the applied magnetic field after the alloy powder has been oriented. As a result, the magnetization of each grain decreases, which alleviates the deterioration in the degree of orientation due to the magnetic interaction among the neighboring grains, so that a high degree of orientation is achieved. In principle, this is the same as what occurs during the process of improving the degree of orientation of a NdFeB system sintered magnet after the production is improved through the temperature-programmed orientation.

In summary, in the method for producing a NdFeB system sintered magnet according to the present example, although the temperature-programmed orientation is not performed, a high degree of orientation can be achieved as in the case of the temperature-programmed orientation, so that the production process can be simplified and the production time can be reduced.

Each of the sintering temperatures shown in Table 2 is the temperature at which the density of a sintered body for a given combination of the composition and the production method will be closest to the theoretical density of the NdFeB system sintered magnet. As shown in Table 2, it has been found that the sintering temperature in the present example tends to be lower than in the comparative example. The decrease in the sintering temperature leads to a decrease in the energy consumption through the production of the NdFeB system sintered magnet, and therefore, to the saving of energy. Another favorable effect is the extension of the service life of the mold, which is also heated with the alloy powder.

It can also been understood from the results of Table 2 that the NdFeB system sintered magnets produced by the method according to the present example have higher coercive forces $H_{cJ}$ than the NdFeB system sintered magnets produced by the method according to the comparative example.

Subsequently, a measurement by Auger electron spectroscopy (AES) was conducted to examine the fine structure of the NdFeB system sintered magnets produced by the method according to the present example as well as that of the NdFeB system sintered magnets produced by the method according to the comparative example. The measurement device was an Auger microprobe manufactured by JEOL Ltd. (product name: JAMP-9500F).

A brief description of the principle of the Auger electron spectroscopy is as follows: In Auger electron spectroscopy, an electron beam is cast onto the surface of a target object, and the energy distribution of Auger electrons produced by the interactions between the electrons and the atoms irradiated with those electrons is determined. An Auger electron has an energy value specific to each element. Therefore, it is possible to identify the elements existing on the surface of the target object (more specifically, in the region from the surface to a depth of a few nanometers) by analyzing the energy distribution of the Auger electrons (qualitative analysis). It is also possible to quantify the amounts of elements from the ratios of their peak intensities (quantitative analysis).

The distribution of the elements in the depth direction of the target object can be determined by an ion-sputtering of the surface of the target object (e.g. by a sputtering process using Ar ions).

The actual method of analysis was as follows: To remove contaminations from the surface of a sample, the sputtering of the sample surface was performed for 2-3 minutes before the actual measurement, with the sample inclined at an angle for the Ar sputtering (30 degrees from the horizontal plane). Next, an Auger spectrum was acquired at a few points of Nd-rich phase in the grain-boundary triple point where C and O could be detected. Based on the spectrum, a detection threshold was determined (ROI setting). The spectrum-acquiring conditions were 20 kV in voltage, $2\times10^{-8}$ A in electric current, and 55 degrees in angle (from the horizontal surface). Subsequently, the actual measurement was performed under the same conditions to acquire Auger images for Nd and C.

Figure 5A:
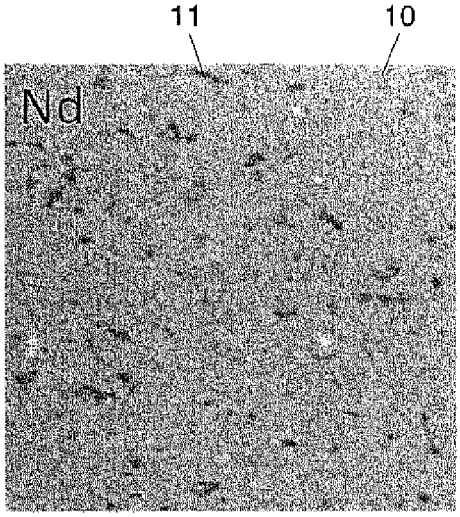
FIGS. 5A-5D are mapping images obtained by Auger electron spectroscopy on a magnet surface of one example of the NdFeB system sintered magnet according to the present invention, which was produced by the method for producing a NdFeB system sintered magnet according to the present example.
Figure 5C:
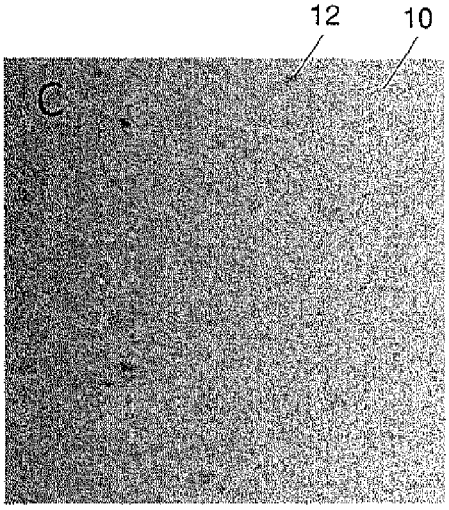
Figure 5B:
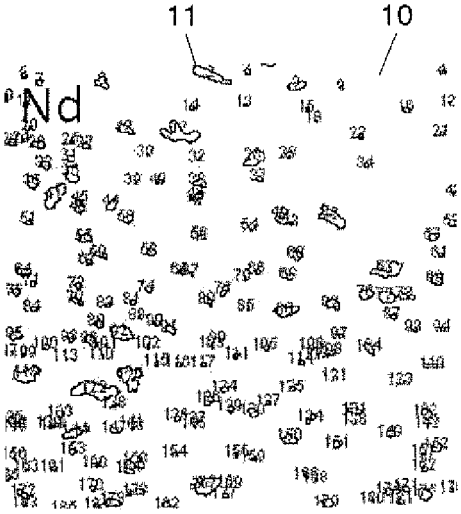
Figure 5D:
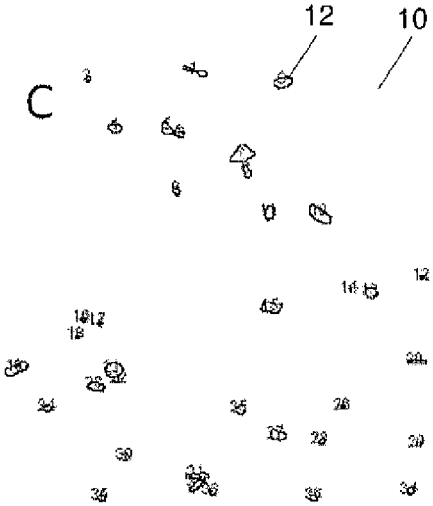
Figure 6A:
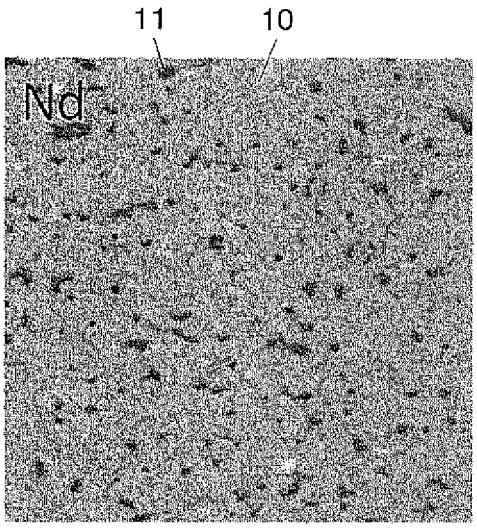
FIGS. 6A-6D are mapping images obtained by Auger electron spectroscopy on the surface of a NdFeB system sintered magnet produced by the method for producing a NdFeB system sintered magnet according to the comparative example.
Figure 6C:
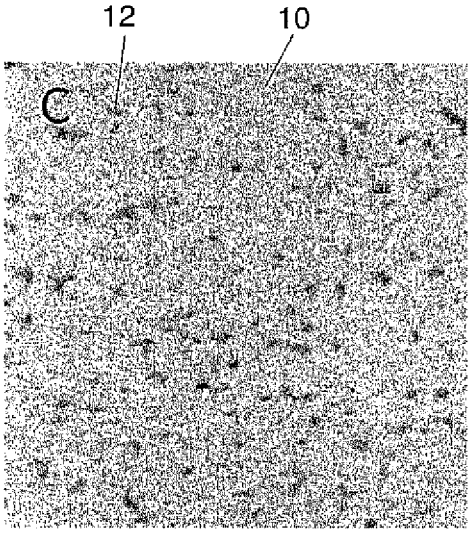
Figure 6B:
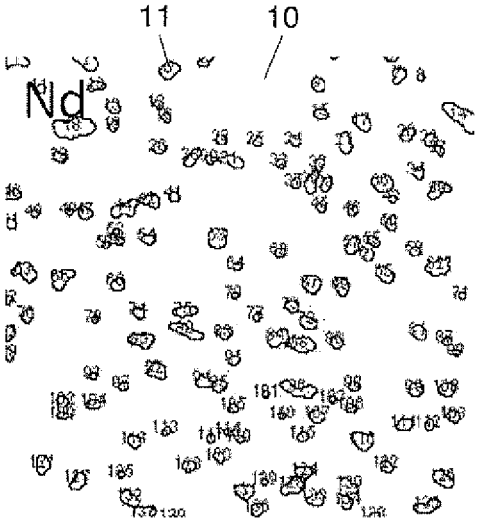
Figure 6D:
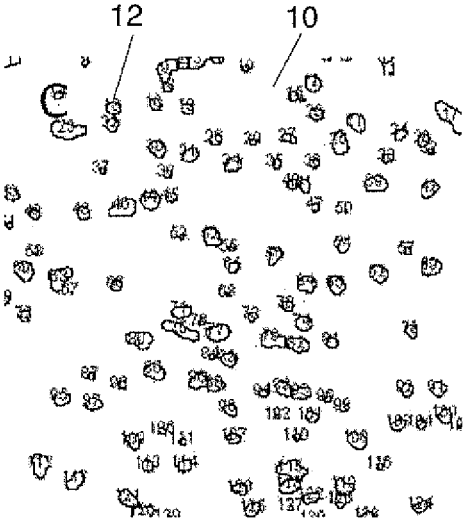

In the present analysis, Auger images of Nd and C (FIGS. 5A-5D and 6A-6D) were acquired by scanning the surface 10 of each of the NdFeB system sintered magnets produced from the alloy of Composition Number 2 in Table 1 by the methods of the present example and the comparative example. Actually, Nd was present almost over the entire surface of the NdFeB system sintered magnets (FIGS. 5A and 6A), from which the region 11 with the Nd concentration higher than the average value over the entire NdFeB system sintered magnet was extracted by an image processing as the Nd-rich grain-boundary triple-point region (FIGS. 5B and 6B). C-rich regions 12 (FIGS. 5D and 6D) were also extracted from the images of FIGS. 5C and 6C.

After the aforementioned regions were extracted, the total area of the Nd-rich grain-boundary triple-point region 11 and that of the C-rich areas 12 located in the Nd-rich grain-boundary triple-point region 11 were calculated. The calculated areas were defined as the volumes of the respective regions, and the ratio C/Nd of the two regions was calculated. Such an image processing and calculation was performed for each of a plurality of visual fields.

Figure 7:
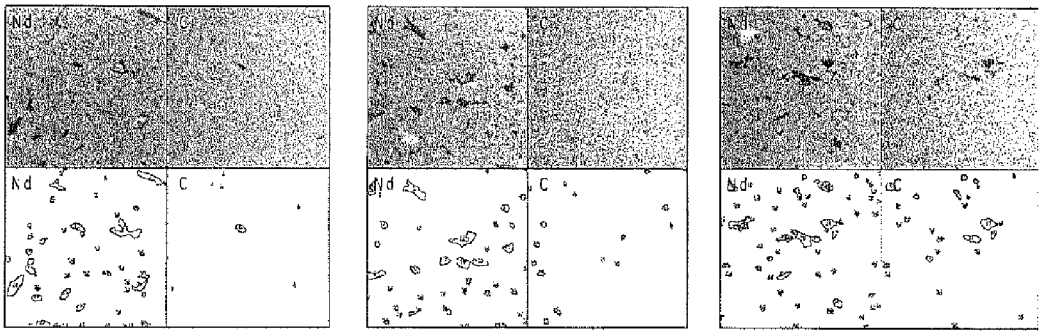
FIG. 7 shows mapping images obtained by Auger electron spectroscopy on the surface of the NdFeB system sintered magnet of the present example.
Figure 8:
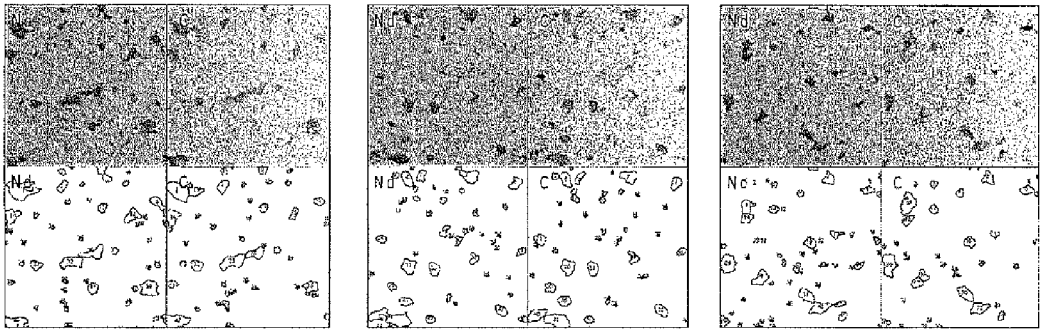
FIG. 8 shows mapping images obtained by Auger electron spectroscopy on the surface of a NdFeB system sintered magnet produced by the method for producing a NdFeB system sintered magnet according to the comparative example.

The surface of each of the NdFeB system sintered magnets of the present and comparative examples produced from Composition Number 2 were divided into small areas of 24 μm×24 μm, and the distributions of Nd and C as well as the C/Nd ratio were analyzed for each small area. FIGS. 7 and 8 show the result of the analysis. (It should be noted that each of FIGS. 7 and 8 show only three small areas which are representative).

In the case of the NdFeB system sintered magnet of the present example, the C/Nd ratio was equal to or lower than 20% in most of the small areas. Although the C/Nd ratio reached 50% in some of the small areas, none of the small areas had a C/Nd ratio over 50%. The C/Nd ratio over the entire area (the entire group of the small areas) was 26.5%.

In the case of the NdFeB system sintered magnet of the comparative example, the C/Nd ratio was as high as 90% or even higher in almost all the small areas. The C/Nd ratio over the entire area was 93.1%.

The carbon contained in the rare-earth rich phase exists either as a simple substance of carbon or in the form of carbon compounds. As in the case of carbon compounds, rare-earth carbides abundantly exist.

Figure 9:
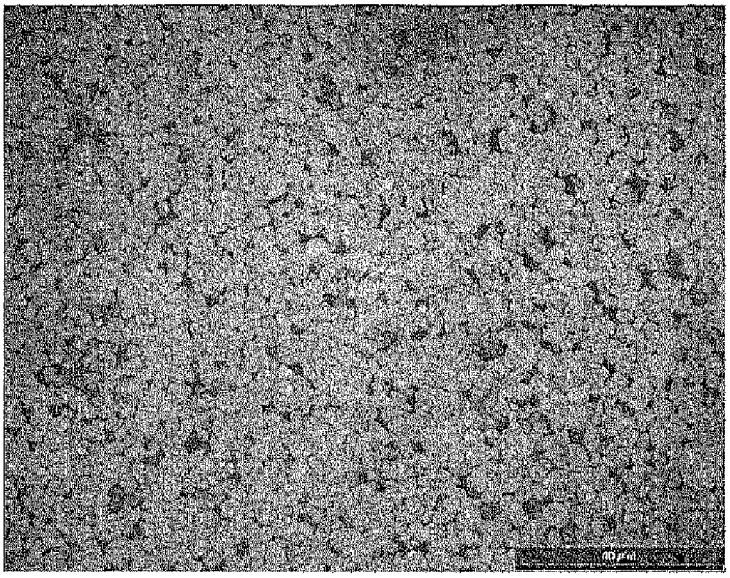
FIG. 9 is an optical micrograph of the NdFeB system sintered magnet of the present example.

The carbon content of the NdFeB system sintered magnet takes approximately the same value for each production method. The carbon content of a NdFeB system sintered magnet corresponding to Composition Number 3 in Table 1, which was measured by using the CS-230 type carbon-sulfur analyzer manufactured by LECO Corporation, was approximately 1100 ppm for a magnet produced by the method according to the comparative example and approximately 800 ppm for a magnet produced by the method according to the present example. A grain-size distribution of each of the NdFeB system sintered magnets produced by the method according to the present example was also determined by taking micrographs of the magnet within a plurality of visual fields (FIG. 9 shows one of those micrographs) and analyzing those micrographs by using an image analyzer (LUZEX AP, manufactured by Nireco Corporation). The average grain sizes of the main-phase grains were within a range from 2.6 to 2.9 μm.

In the following description, a NdFeB system sintered magnet which satisfies the following conditions is called the "NdFeB system sintered magnet of the present example": (i) the average grain size of the main-phase grains of the NdFeB system sintered magnet is equal to or smaller than 4.5 μm; (ii) the carbon content of the NdFeB system sintered magnet is equal to or lower than 1000 ppm; and (iii) the volume ratio of the C-rich regions to the Nd-rich grain-boundary triple-point regions is equal to or lower than 50%. Furthermore, a NdFeB system sintered magnet which partially or entirely lacks these characteristics (i)-(iii) is hereinafter called the "NdFeB system sintered magnet of the comparative example."

Tables 3 and 4 show the magnetic characteristics of the NdFeB system sintered magnets of the present example and those of the NdFeB system sintered magnets of the comparative example, as well as their magnetic characteristics of after they have been employed as base materials for the grain boundary diffusion method.

Present Examples 1-4 in Table 3 are NdFeB system sintered magnets having the aforementioned characteristics (i)-(iii), which were respectively produced from the alloys of Composition Numbers 1-4 by the method according to the present example, each magnet measuring 7 mm in length, 7 mm in width and 3 mm in thickness, with the direction of magnetization coinciding with the thickness direction. Comparative Examples 1-4 in Table 4 are NdFeB system sintered magnets which were respectively produced from the alloys of Composition Numbers 1-4 by the method according to the comparative example, with the same size as Present Examples 1-4. Each of these NdFeB system sintered magnets of Present Examples 1-4 and Comparative Examples was used as a base material for the grain boundary diffusion method, as will be described later.

TABLE 3

| Sample Name | Br (kG) | HcJ (kOe) | HcB (kOe) | BHMax (MGOe) | Js (kG) | SQ (%) | Br/Js (%) |
|---|---|---|---|---|---|---|---|
| Present Example 1 | 14.24 | 15.68 | 13.92 | 49.60 | 14.83 | 96.5 | 96.0 |
| Present Example 2 | 13.94 | 17.71 | 13.60 | 47.53 | 14.59 | 95.5 | 95.5 |
| Present Example 3 | 13.66 | 20.12 | 13.06 | 45.07 | 14.25 | 94.8 | 95.8 |
| Present Example 4 | 13.56 | 21.86 | 13.26 | 44.56 | 14.04 | 95.1 | 96.6 |
| Comparative Example 1 | 14.27 | 15.50 | 13.80 | 50.10 | 14.86 | 89.9 | 96.1 |
| Comparative Example 2 | 13.93 | 16.25 | 13.27 | 47.11 | 14.63 | 91.4 | 95.2 |
| Comparative Example 3 | 13.70 | 17.79 | 13.21 | 45.62 | 14.39 | 92.1 | 95.2 |
| Comparative Example 4 | 13.44 | 20.49 | 12.93 | 43.21 | 14.06 | 93.8 | 95.6 |

In this table, $B_r$ is the residual magnetic flux density (the magnitude of the magnetization J or magnetic flux B at a magnetic field of H=0 on the magnetization curve (J-H curve) or demagnetization curve (B-H curve)), $J_s$ is the saturation magnetization (the maximum value of the magnetization J), $H_{cB}$ is the coercive force defined by the demagnetization curve, $H_{cJ}$ is the coercive force defined by the magnetization curve, $(BH)_{max}$ is the maximum energy product (the maximum value of the product of the magnetic flux density B and the magnetic field H on the demagnetization curve), $B_r/J_s$ is the degree of orientation, and SQ is the squareness ratio. Larger values of these properties mean better magnetic characteristics.

As shown in Table 3, when the composition is the same, the NdFeB system sintered magnet of the present example has a higher coercive force Rd than the NdFeB system sintered magnet of the comparative example. There is no significant difference in the degree of orientation $B_r/J_s$. However, as for the squareness ratio SQ, the NdFeB system sintered magnets of the present example has achieved extremely high values as compared to the NdFeB system sintered magnets of the comparative example.

Table 4 below shows the magnetic characteristics after the grain boundary diffusion treatment was performed using each of the NdFeB system sintered magnets shown in Table 3 as the base material and using Tb as $R_H$.

TABLE 4

| Sample Name | Br (kG) | HcJ (kOe) | HcB (kOe) | BHMax (MGOe) | Js (kG) | SQ (%) | Br/Js (%) |
|---|---|---|---|---|---|---|---|
| Present Example 1 | 14.02 | 25.04 | 13.76 | 48.11 | 14.63 | 96.2 | 95.9 |
| Present Example 2 | 13.72 | 28.01 | 13.28 | 45.70 | 14.29 | 95.6 | 96.3 |
| Present Example 3 | 13.55 | 31.39 | 13.14 | 44.84 | 14.09 | 95.0 | 95.7 |
| Present Example 4 | 13.38 | 32.60 | 13.08 | 43.79 | 13.89 | 95.6 | 96.4 |
| Comparative Example 1 | 13.98 | 24.60 | 13.66 | 47.88 | 14.04 | 86.6 | 96.0 |
| Comparative Example 2 | 13.65 | 25.53 | 13.19 | 45.67 | 14.26 | 88.1 | 95.7 |
| Comparative Example 3 | 13.57 | 27.69 | 13.13 | 44.94 | 14.22 | 89.5 | 95.4 |
| Comparative Example 4 | 13.20 | 29.81 | 12.84 | 41.67 | 13.84 | 88.3 | 95.5 |

The grain boundary diffusion (GBD) was performed as follows:

A TbNiAl alloy powder composed of 92 wt % of Tb, 4.3 wt % of Ni and 3.7 wt % of Al was mixed with a silicon grease by a weight ratio of 80:20. Then, 0.07 g of silicon oil was added to 10 g of the aforementioned mixture to obtain a paste, and 10 mg of this paste was applied to each of the two magnetic pole faces (7 mm×7 mm in size) of the base material.

After the paste was applied, the rectangular base material which was placed on a molybdenum tray provided with a plurality of pointed supports. The rectangular base material, being held by the supports, was heated in a vacuum of $10^{-4}$ Pa. The heating temperature was 880 degrees Celsius, and the heating time was 10 hours. Subsequently, the base material was quenched to room temperature, after which it was heated at 500 degrees Celsius for two hours and then once more quenched to room temperature.

As shown in Table 4, the sintered magnets of the present example which have the aforementioned characteristics (i)-(iii) have much higher coercive forces $H_{cJ}$ than the sintered magnets of the comparative example which do not have the characteristics (i)-(iii). In Table 3, some of the NdFeB system sintered magnets of the comparative example have higher maximum energy products $(BH)_{max}$ than the NdFeB system sintered magnets of the present example (with the same composition). By contrast, in Table 4, all the NdFeB system sintered magnets of the present example have higher maximum energy products $(BH)_{max}$ than the NdFeB system sintered magnets of the comparative example. That is to say, the amounts of decrease in $(BH)_{max}$ of the NdFeB system sintered magnets of the present example are smaller than those of the NdFeB system sintered magnets of the comparative example. The extremely high squareness ratios SQ should also be noted.

There are two probable reasons for the fact that the NdFeB system sintered magnets of the present example have high magnetic characteristics before and after the grain boundary diffusion treatment: The first reason is that carbon-rich regions can barely develop in the Nd-rich grain-boundary triple-point regions, since the carbon content of the NdFeB system sintered magnet is low. The second reason is that an adequate amount of $R_H$ (which is Tb in the present example) can be diffused into the inner region of the base material through the passage of the Nd-rich phase, since there is only a small amount of C-rich regions in the Nd-rich grain-boundary triple-point regions.

The low percentage of the carbon-rich phase in the Nd-rich phase of the NdFeB system sintered magnet of the present example allows $R_H$ to be efficiently diffused through the Nd-rich phase in the grain boundaries. An experiment conducted by the present inventors has demonstrated that, when $R_H$ is applied to two opposite faces of a magnet, $R_H$ can be diffused to a depth of 5 mm from each face, and therefore, can reach the center of a magnet whose thickness is as large as 10 mm. Table 5 shows an increase in the coercive force before and after the grain boundary diffusion treatment of the NdFeB system sintered magnets of the present example corresponding to the alloys of Composition Numbers 1 and 3 as well as the NdFeB system sintered magnet of the comparative example corresponding to the alloy of Composition Number 2, each of which was produced with three thicknesses of 3 mm, 6 mm and 10 mm.

TABLE 5

| | Composition | Increase in Coercive Force (kOe) | | |
|---|---|---|---|---|
| | No. | 3 mm thick | 6 mm thick | 10 mm thick |
| Present Example | 1 | 9.4 | 9.0 | 6.0 |
| Present Example | 3 | 11.3 | 10.0 | 8.0 |
| Comparative Example | 2 | 9.3 | 6.5 | 3.0 |

As can be seen in this table, there is no significant difference between the NdFeB system sintered magnets of the present example and that of the comparative example in the case of the 3-mm thickness. As the magnets become thicker, the NdFeB system sintered magnets of the present example come to exhibit its superiority in terms of the coercive force. For example, in the case of the NdFeB system sintered magnets of the present example, the amounts of increase in the coercive force at a thickness of 6 mm were maintained at approximately the same levels as they were at a thickness of 3 mm, whereas the amount significantly decreased in the case of the NdFeB system sintered magnets of the comparative example. A larger increase in the coercive force suggests that $R_H$ is diffused to the center of the magnet. These results demonstrate that the NdFeB system sintered magnets produced by the method according to the present example are suitable as a base material for producing a thick magnet having high magnetic characteristics by a grain boundary diffusion treatment.

EXPLANATION OF NUMERALS

10 . . . Surface of NdFeB System Sintered Magnet
11 . . . Region Where Nd-Rich Phase Exists
12 . . . Region Where Carbon is Distributed

The invention claimed is:

1. A NdFeB system sintered magnet, wherein:

a) an average grain size of a main-phase grains in the NdFeB system sintered magnet is equal to or smaller than 4.5 μm;

b) a carbon content of the entire NdFeB system sintered magnet is greater than 0 ppm and equal to or lower than 1000 ppm; and c) a percentage of a total volume of a carbon rich phase in a rare-earth rich phase at a grain-boundary triple point in the NdFeB system sintered magnet to a total volume of the rare-earth rich phase is greater than 0% and equal to or lower than 50%.

2. A method for producing the NdFeB system sintered magnet according to claim 1, comprising:

a) a hydrogen pulverization process for coarsely pulverizing a NdFeB system alloy by making the NdFeB system alloy occlude hydrogen;

b) a fine pulverization process for finely pulverizing the coarsely pulverized NdFeB system alloy so that a grain size of the alloy will be equal to or smaller than 3.2 μm in terms of a median $D_{50}$ of a grain size distribution measured by a laser diffraction method; and c) a press-less magnet-production process including a step of putting fine powder of the NdFeB alloy into a filling container and a subsequent step of orienting and sintering the fine powder as held in the filling container, wherein:

the fine pulverization process and the press-less magnet-production process are performed without thermal dehydrogenation for desorbing the hydrogen occluded in the hydrogen pulverization process; and the processes from the hydrogen pulverization process through the press-less magnet-production process are performed in an oxygen-free atmosphere.

* * * * *